United States Patent [19]

Haley et al.

[11] 4,314,887

[45] Feb. 9, 1982

[54] APPARATUS FOR PRODUCING COKE FROM FINE AND COARSE COAL

[75] Inventors: Jack R. Haley, Nashville; Jimmy B. Smith, Columbia; Vaughn Mansfield, Gallatin, all of Tenn.

[73] Assignee: Peabody Coal Company, Inc., St. Louis, Mo.

[21] Appl. No.: 66,403

[22] Filed: Aug. 14, 1979

Related U.S. Application Data

[62] Division of Ser. No. 917,108, Jun. 19, 1978, Pat. No. 4,196,051.

[51] Int. Cl.[3] ..... C10B 7/06; C10B 31/00

[52] U.S. Cl. ..... 202/91; 202/215; 202/262

[58] Field of Search ..... 202/91, 108, 117, 134, 202/208, 215, 262; 201/24, 26, 32, 40; 431/178, 179, 181; 432/7, 122, 239

[56] References Cited

U.S. PATENT DOCUMENTS

| | | | |
|---|---|---|---|
| 1,906,755 | 5/1933 | Karrick | 201/40 |
| 3,560,369 | 2/1971 | Rowland et al. | 201/40 |
| 4,156,595 | 5/1979 | Scott et al. | 201/40 |

*Primary Examiner*—Bradley Garris
*Attorney, Agent, or Firm*—Littlepage & Webner

[57] ABSTRACT

Adjacent alternating rows of relatively coarse and fine coal are deposited onto a horizontal moving grate running through a coking furnace.

2 Claims, 3 Drawing Figures

APPARATUS FOR PRODUCING COKE FROM FINE AND COARSE COAL

This is a division of Ser. No. 917,108, filed June 19, 1978, now U.S. Pat. No. 4,196,051, for "Method and Apparatus for Producing Coke from Fine and Coarse Coal."

FIELD OF INVENTION

Distillation apparatus, retort, horizontal.

PRIOR ART

Mansfield, U.S. Pat. Nos. 2,997,426; 3,434,932 and 3,434,933 and Mansfield et al, U.S. Pat. No. 3,969,088.

BACKGROUND AND OBJECTS

In continuous coking or charring processes, one of the most difficult operations is to pass air upwardly or to downdraft gas through a moving fuel bed when the fuel bed contains an excess of minus ¼ inch size fraction coal. When attempt is made to pass air upwardly through such a bed the usual results are reduced production rates, excessive fluidization, lower coal to coke or char yields, lower fixed carbon recovery and excessive fly ash. Downdrafting gas through a bed with excessive fines generally causes an excessive quantity of fines to be drawn into the under grate zones where a fire hazard exists if the sifting removal capacity is exceeded.

In order to overcome the coal size limitations imposed upon prior art processes, we have devised a method whereby more than 25% coal fines can be utilized by selective column or row loading of coarse and fine sizes. This method for producing chemical grade coke or char is especially applicable where the char size reduction is required either for direct use or for char briquetting or where a binder is used to produce metallurgical coke, such as in Mansfield et al U.S. Pat. No 3,969,088 (supra). This improved method not only allows the use of coals containing fines (minus ¼ inch by 0) in the range of 40 to 60%, but it also improves the chemical quality of the coke thus produced.

Among the advantages of this apparatus and method are the ability to use more economical coals for coke production without reducing production rate or increasing fluidization which produces particulate emissions. Modern continuous mining methods oftentimes produce up to 60% coal fines, and consequently a process such as this which can use all of the normally produced fines in the coal tends to be more economical than a process requiring double screen coal size, which limits the amount of ¼ by 0 to approximately 25%. The market price for double screen sizes of coal is normally greatly higher than the as mined coal sizes. Other advantages of the process are greater yield of coke per ton of coal fed and greater density of the coke product. A further feature of the invention is the use of lower coal to air ratio than in the most nearly comparable prior art processes, which results in a greater recovery of fixed carbon. This is due to characteristics of the coal in the coarse columns or rows which cokes with less air than required when greater than 25% fines are intimately mixed or layer loaded, as in the prior art. In addition, this improved method reduces the amount of crushing required to produce small size coke when needed either for direct use of for briquetting with a binder.

These and other objects will be apparent from the following specifications and drawings in which.

Figure 1:
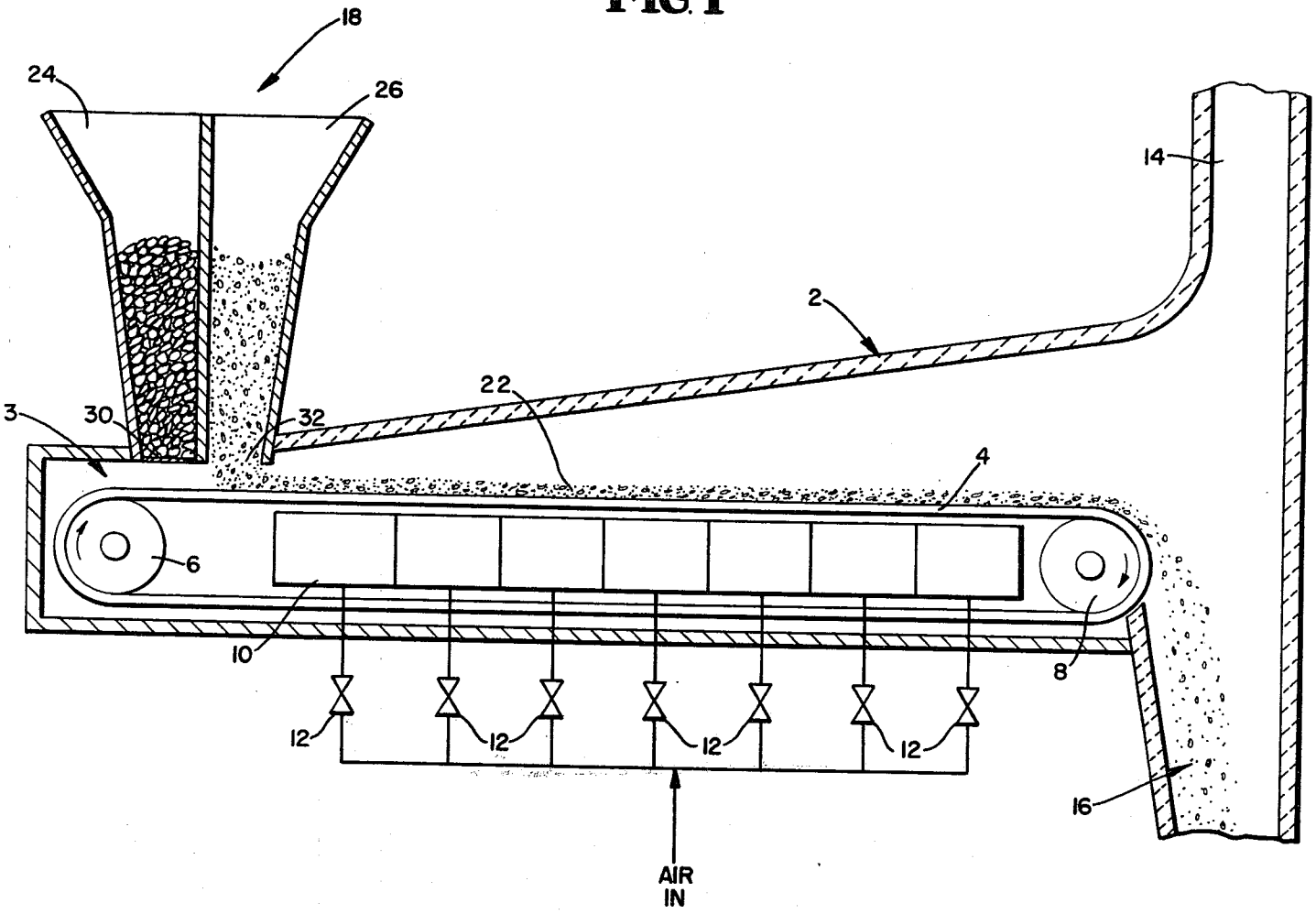
FIG. 1 is a diagrammatic cross-section along the line 1—1 of FIG. 3.
Figure 2:
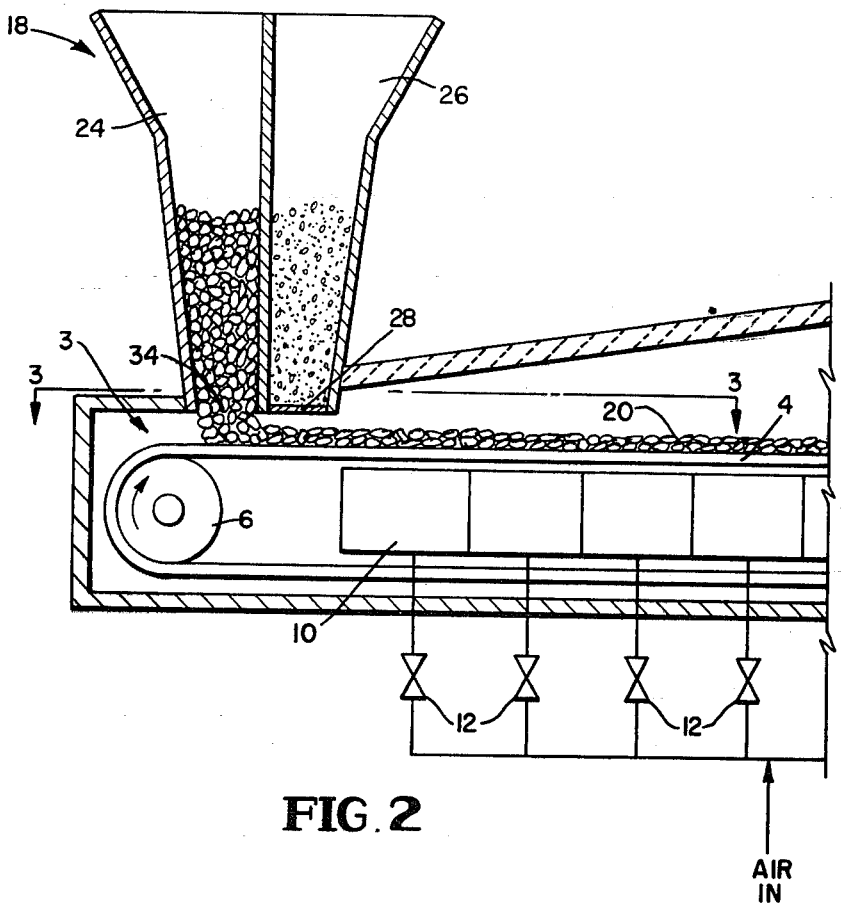
FIG. 2 is a diagrammatic cross-section along the line 2—2 of FIG. 3.

Referring now to the drawings, in which like reference numerals denote similar elements, the coking oven denoted generally at 2 has running through it from front to rear a horizontal chain grate 4 which turns over sprockets 6 and 8 at each end of the grate run. A suitable source of power drives the sprockets to turn in the direction of the arrows. Between the upper and lower grate runs is a zoned air box 10 having valve control air input lines 12. Above the end of oven 2 is a flue 14 from which the hot gases evolved in the process are discharged, and beneath the rear end of the coking oven is a shaft furnace 16 into which the coke or char drops. The arrangement thus far described is similar to the utilized in the Mansfield patents (supra). This invention is concerned with the coal feed 18 at the input end of the furnace and the deposit of side by side rows, alternating, of coarse coal 20 and fines 22.

Figure 3:
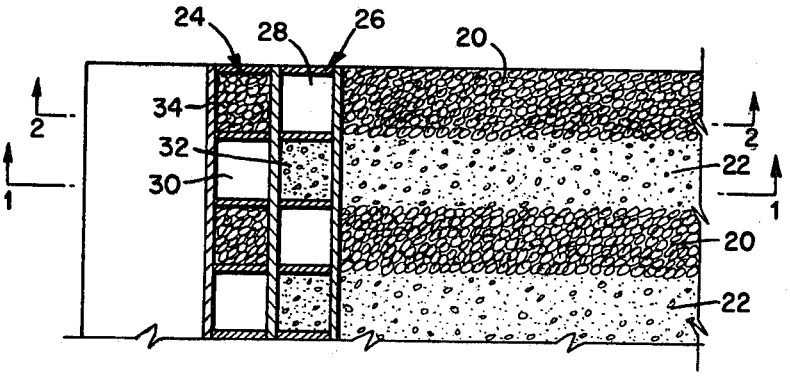
FIG. 3 is a diagrammatic cross-section along the lines 3—3 of FIG. 2.

Above the input end of the furnace is a coarse coal hopper 24 and a fines hopper 26 from which the alternating coarse and fines are deposited to form moving bed 20 on chain grate 4. Disposed at spaced intervals across the bottom of the coarse coal hopper are plates 30 and disposed across the bottom of the fines hopper 26 at spaced intervals are plates 28, the plates 30 being staggered with respect to the plates 28. The spacing of plates 28 from one another leaves a series of windows 32 through which the fine coal drops onto the chain grate. Likewise, the spacing between the plates 30 leaves a series of windows 34 through which the coarse coal drops onto the chain grate. As will be seen particularly in FIG. 3, this arrangement deposits alternating side by side rows 20 and 22 on the chain grate as the latter moves beneath the windows 32 and 34 in the bottoms of the fine coal and coarse coal hoppers.

In typical operation coarse coal nominally sized within the range of 3"×¼" is loaded into coarse coal hopper 24 and fines nominally sized ¼"×0 are loaded into the fine coal hopper 26 and the windows are sized so that the total weight of the fines deposited on the chain grate is from 40% to 60% of the total weight of the coal. The air feed is adjusted so as to provide about 0.5 to 1.5 pounds of air per pound of coal fed through the oven. Assuming a grate run of from 20 to 40 feet in length and 15 to 30 feet in width, a grate speed of from 20 to 100 feet per hour and from 10 to 90 rows of coarse coal and from 10 to 90 rows of fine coal running along the grate and assuming an average temperature of from 1600° to 2400° F. in the atmosphere over the bed and further assuming an average bed temperature at the end of the grate run to be about 1800° F. and further assuming the green coal input to be Western Kentucky No. 11, the following action takes place on the bed:

With alternate rows of fine and coarse coal with heights from 2" to 12" and thicknesses from 1" to 12", air flows through the coarse coal to promote ignition and maintain combustion. After ignition, the incandescent or combustion plane moves downward through the bed and simultaneously removes volatile matter or cokes the coarse coal which releases sufficient heat to ignite and maintain combustion in the fine coal rows. The incandescent or coking plane simultaneously moves laterally from the outside to the center of each fine coal row and downward along with the incandescent line in the coarse coal. Since very little air passes through the fine coal rows, agglomeration increases, fixed carbon recovery increases and very little fluidization occurs.

What is claimed is:

1. Appparatus for producing coke from a plurality of coals of respectively different type characteristics comprising:

a coking furnace having input and output ends, a continuous conveyor providing a flat conveyor run moving horizontally through the furnace from the input end to output end thereof, at least two coal hoppers, a plurality of spaced outlet means for feeding coal from one hopper onto the conveyor run at a plurality of locations which are spaced from one another in a direction transverse to the direction of movement of the conveyor run so as to form a plurality of spaced rows of coal from one hopper along the conveyor run, and another plurality of spaced outlet means for feeding coal from the other hopper onto the conveyor run into the spaces between the first mentioned rows.

2. Apparatus for producing coke from two different sizes of coal of respectively different type characteristics comprising: a coking furnace having input and output ends, a continuous endless traveling grate conveyor providing a flat upper conveyor run movable horizontally through the furnace from the input end to output end thereof, at least two coal hoppers, one for relatively large coal and one for relatively fine coal, a plurality of spaced outlet means for feeding relatively large coal from the one hopper onto the conveyor run at a plurality of locations which are spaced from one another in a direction transverse to the direction of movement of the conveyor run so as to form a plurality of spaced rows of coal from said one hopper along the conveyor run, and another plurality of spaced outlet means for feeding relatively fine coal from the other hopper onto the conveyor run for filling the spaces between the first mentioned rows.

* * * * *